US005366052A

United States Patent [19]

Keh-Lin

[11] Patent Number: 5,366,052

[45] Date of Patent: Nov. 22, 1994

[54] REVERSIBLE FOLDING LADDER

[76] Inventor: Jeng Keh-Lin, No. 1-1, Sec. 2, Yang-Hwu Rd., Yangmei, Taoyuan Hsien,

[21] Appl. No.: 93,628

[22] Filed: Jul. 20, 1993

[51] Int. Cl.[5] ..... E06C 5/00

[52] U.S. Cl. ..... 182/88; 182/96; 182/97; 182/129; 182/127

[58] Field of Search ..... 182/88, 127, 93, 96, 182/95, 129, 97; 280/163, 164.1

[56] References Cited

U.S. PATENT DOCUMENTS 3,291,255 12/1966 Glatfelter ..... 182/88

*Primary Examiner*—Alvin C. Chin-Shue
*Attorney, Agent, or Firm*—Bacon & Thomas

[57] ABSTRACT

This invention relates to a reversible folding ladder which is composed of a ladder, two steel channels, a front frame and a rear frame. More particularly the ladder is composed of a front staircase and a rear staircase. There is a plurality of foot pedals hinged on both the front staircase and the rear staircase and the top of both the front staircase and the rear staircase is hinged on the front frame. Furthermore the front frame is connected with the rear frame by a pivot rod and can be reversed. A connecting part of the rear frame and the pivot rod can be rotated. When unfolding the reversible folding ladder to contact the ground, each foot pedals is arranged parallel with the front frame. Furthermore when the reversible folding ladder is rotated to a position parallel with the front frame, the rear staircase can be received into the front staircase. Under this condition, the reversible folding ladder can be turned around to make the rear staircase be positioned above the front staircases, then rotated to contact with the ground by means of the rotating part of the rear frame. In the condition, the ladder can be used as a conveyor device for transporting goods by way of rollers or a conveyor belt carried by the rear staircase.

5 Claims, 4 Drawing Sheets

REVERSIBLE FOLDING LADDER

BACKGROUND OF THE INVENTION

This invention relates to a reversible folding ladder, especially a ladder which is installed on a truck for personnel to get on or get off, furthermore the ladder can be reversed as a conveyor device. When the reversible folding ladder is not in use, it can be folded and received within the truck body.

A conventional truck of military vehicle is always equipped with a ladder at its side or rear part to enable personnel to get on or get off conveniently. Such known ladders generally can't be folded or received into the truck body and occupy too much space when they are not in use, furthermore the conventional trucks or military vehicles may be used for transporting any other goods than people. It is therefore necessary for a user to carry an additional conveyor device so as to convey these goods,in other words, a user must spend more time and force to install the conveyor device.

SUMMARY OF THE INVENTION

It is therefore the main object of this invention to provide a reversible folding ladder which is installed on a truck for personnel to get on or get off, furthermore the ladder can be reversed as a conveyor device for transporting goods and, if the reversible folding ladder is not in use, it can be folded and received within truck body.

It is further another object of this invention to provide a reversible folding ladder which can be unfolded to form a four-link mechanism. Once the bottom of the front staircase contacts the ground, each foot pedal is positioned parallel with the truck body.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENTS

Figure 1:
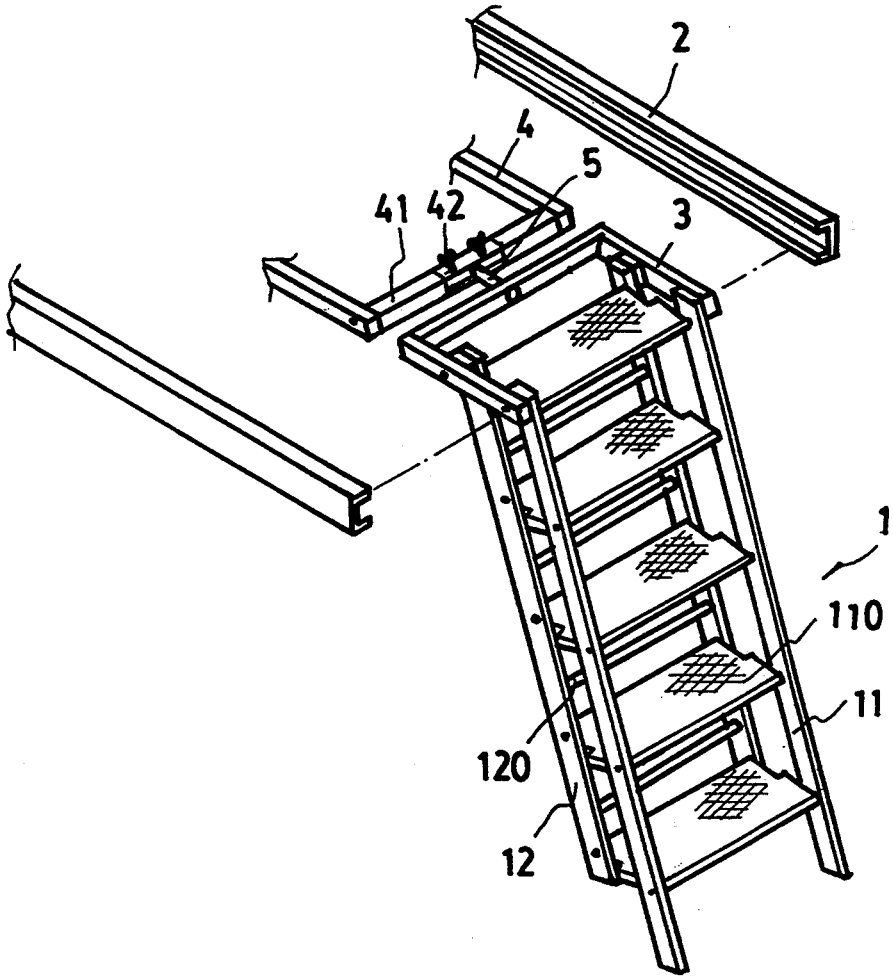
FIG. 1 is a perspective view of the invention.

Referring to FIG. 1, the reversible folding ladder (1) is installed on trucks or military vehicles for people to get on or get off the car.

The reversible folding ladder (1) is composed of a pair of steel channels (2) (2') , a front frame (3) and a rear frame (4), wherein the channels (2) (2') are welded respectively on one side of a depositing place (10). The front frame (3) is connected with the rear frame (4) and can be reversed freely by means of a pivot rod (5). Furthermore the two sides of the front frame (3) and the rear frame (4) are installed between the pair of channels (2) (2') and can be slidably shifted on them freely. The rear frame (4) has a rotating part (41) which is connected with the pivot rod (5) by means of butterfly screws (42) so as to enable the front frame (3) to be rotated around the rotating part (41) and separated from the rear frame (4).

The reversible folding ladder (1) is composed of a front staircase (11) and a rear staircase (12) whose upper part is hinged respectively at the front frame (3). Between the front staircase (11) and the rear staircase (12) are positioned a plurality of foot pedals (110), with the two ends of these foot pedals (110) being hinged respectively on the front staircase (11) and the rear staircase (12). Furthermore there is a plurality of rollers (120) rotatably mounted to the rear staircase (12).

Figure 2:
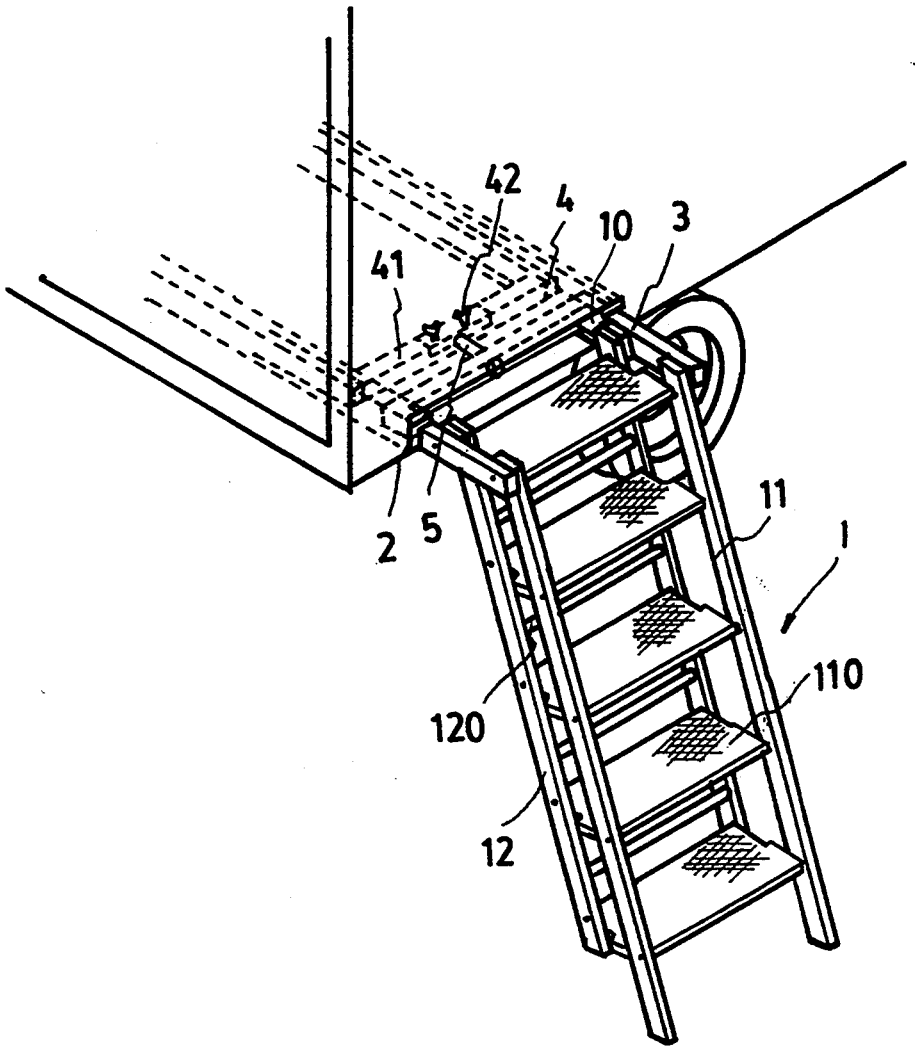
FIG. 2 is a perspective view showing the ladder of this invention pulled out of a car.
Figure 6:
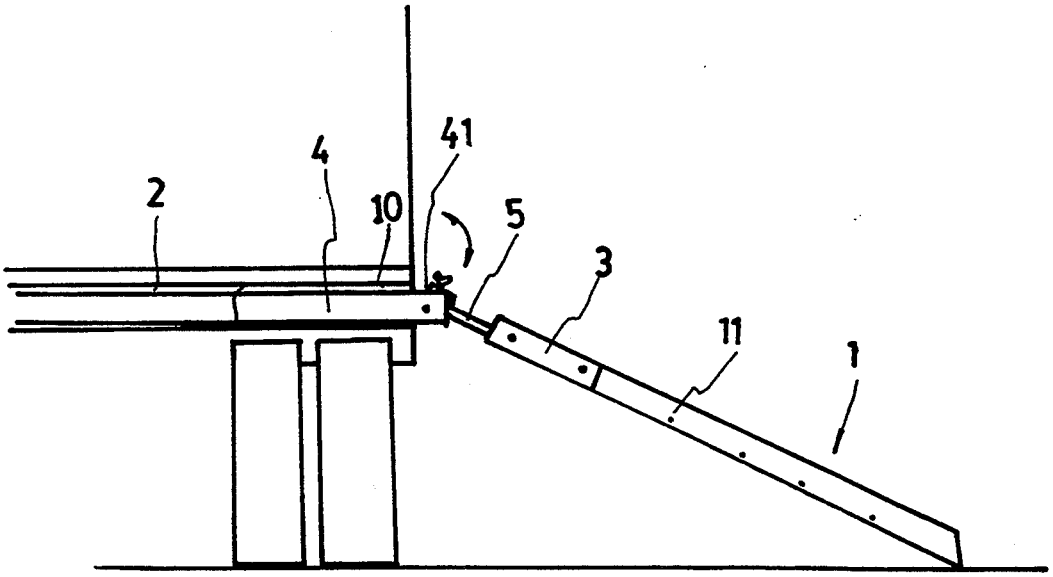
FIG. 6 is a plan view of this invention used as a conveyor device.

Referring to FIG.2, when the reversible folding ladder (1) and the front frame (3) is drawn out from the depositing space (10) and unfolded to contact the ground, the front frame (3), front staircase (11), rear staircase (12) and the foot pedals (110) are formed into a four-link mechanism. Furthermore each foot pedal (110) is positioned parallel with the front frame (3) and car body, therefore the reversible folding ladder (1) can be supported stably with the bottom of the front staircase (11) contacting the ground. Please refer to FIG.3 and FIG.6, when the front staircase (11) and the rear staircase (12) is rotated to parallel with the front frame (3),the rear staircase (12) is received into the front staircase (11). In this condition, the user can turn round the reversible folding ladder (1) to make the rear staircase (12) turn through 180° about the pivot rod (5), then rotate it to contact with the ground by means of the rotating part (41). In this position, the goods or other objects can be conveyed by the rollers (120) of the reversed ladder.

Figure 3:
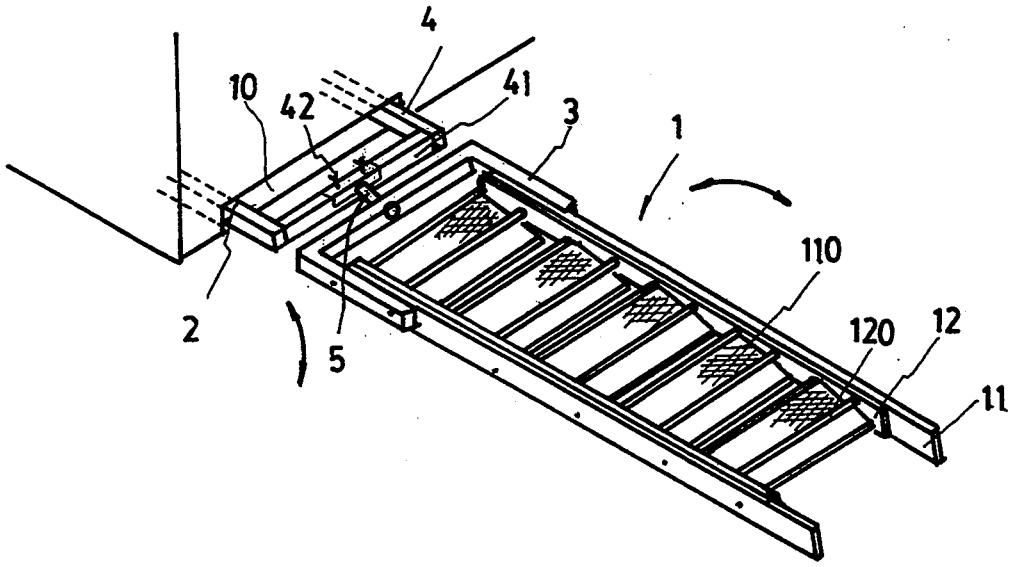
FIG. 3 a perspective view showing the ladder which is reversed as a conveyor device.
Figure 4:
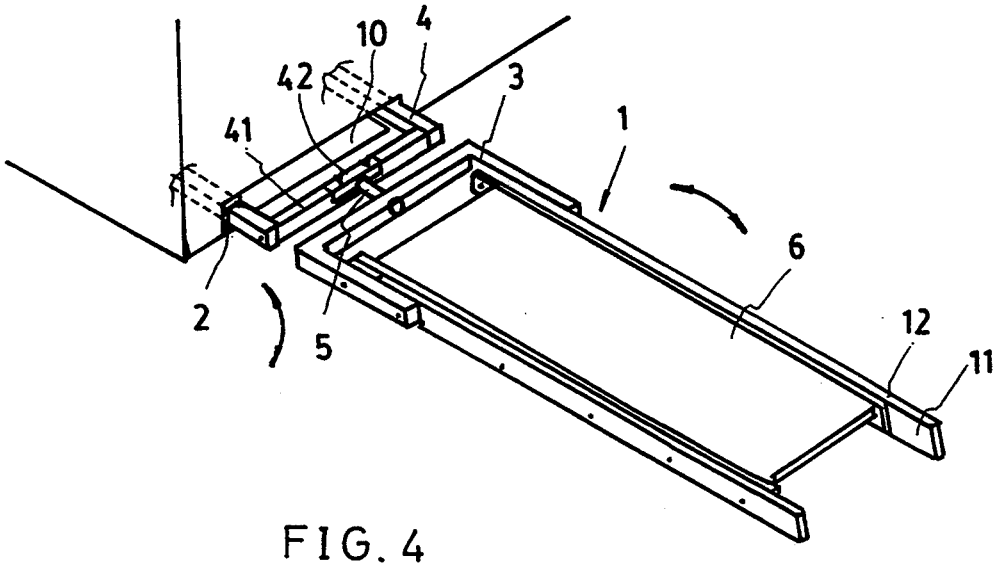
FIG. 4 is a perspective view showing another embodiment of the ladder of this invention used as a conveyor device.
Figure 5:
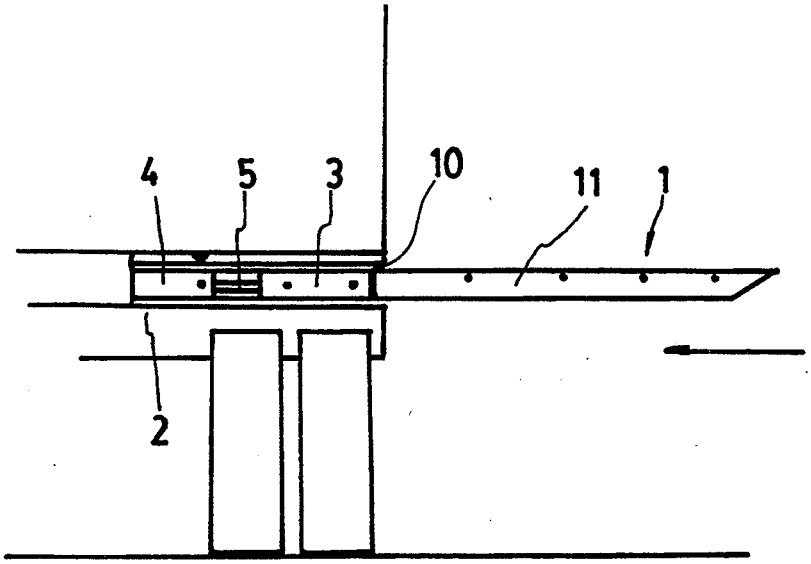
FIG. 5 is a plan view showing the ladder of this invention being stored inside a car body.

FIG.4 shows another embodiment of the reversible folding ladder (1) used as a conveyor device wherein the rollers (120) in the FIG. 3 embodiment have been replaced with a conveyor belt (6) so as to convey goods. If the reversible folding ladder (1) is not in use, the user can lift it up until the reversible folding ladder (1) is arranged parallel to the front frame (3), and thereafter the rear staircase (12) may be received into the front staircase (11). Therefore the reversible folding ladder (1) can be pushed into the depositing space (10), such as shown in FIG. 5. Furthermore the reversible folding ladder (1) and the front frame (3) can be separated from the rear frame (4) by loosening the butterfly screws (42).

It is understood by those skilled in the art that the foregoing description is a preferred embodiment of the disclosed device and that various changes and modifications may be made to the preferred embodiments of the invention as described without departing from the spirit and scope thereof.

What is claimed is:

1. A reversible folding ladder assembly moveable between extended and retracted positions on a vehicle comprising:

a pair of longitudinally extending channel members adapted to be secured, in a spaced, substantially parallel manner, to a vehicle;

a rear frame including a pair of spaced, substantially parallel rear frame members adapted to be slidably received within said pair of channel members, said rear frame further including a rotating part positioned between and rotatably mounted to said rear frame members;

a longitudinally extending pivot shaft carried by said rotating part at a central portion thereof;

a front frame rotatably attached to said rear frame through said pivot shaft, said front frame including a pair of spaced, substantially parallel front frame members adapted to be slidably received within said pair of channel members;

a ladder assembly movable between folded and unfolded positions, said ladder assembly including a front staircase defined by a pair of elongated, spaced front staircase members having respective top and bottom portions, a pair of elongated, spaced rear staircase members having respective top and bottom portions, and a plurality of foot pedals hingedly attached to the front and rear staircase members at spaced intervals, the top portions of each of said front and rear staircase members being rotatably mounted to respective ones of said front frame members wherein, when said reversible folding ladder assembly is in said extended position and said ladder assembly is unfolded, the bottom portions of said front staircase members engage a support area with said plurality of pedals assuming positions substantially parallel to said front frame members; and conveyor means carried by said rear staircase at a side remote from said front staircase members and spaced from said plurality of foots pedals wherein, when said reversible folding ladder is in said extended position with ladder assembly folded, said front frame and said ladder assembly can be rotated relative to said rear frame about said pivot shaft such that said conveyer means is positioned above said plurality of foot pedals.

2. The reversible folding ladder assembly according to claim 1, wherein said conveyor means comprises a plurality of rollers extending, at spaced intervals, between said rear staircase members.

3. The reversible folding ladder assembly according to claim 1, wherein said conveyor means comprises a belt.

4. The reversible folding ladder assembly according to claim 1, further comprising means for readily detaching said front frame from said rear frame.

5. The reversible folding ladder assembly according to claim 4, wherein said detaching means comprises multiple butterfly screws securing said pivot shaft to said rotating part.

* * * * *